US009745524B2

(12) United States Patent
Touzalin et al.

(10) Patent No.: US 9,745,524 B2
(45) Date of Patent: Aug. 29, 2017

(54) PROCESS FOR THE PRODUCTION OF A GASOLINE WITH A LOW SULFUR CONTENT

(71) Applicant: IFP Energies nouvelles, Rueil-Malmaison (FR)

(72) Inventors: Olivier Touzalin, Lyons (FR); Philibert Leflaive, Mions (FR); Diamantis Asteris, Chatou (FR); Delphine Largeteau, Houston, TX (US); Jean Luc Nocca, Houston, TX (US)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 91 days.

(21) Appl. No.: 14/439,458

(22) PCT Filed: Sep. 26, 2013

(86) PCT No.: PCT/FR2013/052270

§ 371 (c)(1),
(2) Date: Apr. 29, 2015

(87) PCT Pub. No.: WO2014/068209

PCT Pub. Date: May 8, 2014

(65) Prior Publication Data

US 2015/0275105 A1 Oct. 1, 2015

(30) Foreign Application Priority Data

Oct. 29, 2012 (FR) ..... 12 02891

(51) Int. Cl.
*C10G 45/38* (2006.01)
*C10G 29/20* (2006.01)
(Continued)

(52) U.S. Cl.
CPC ..... *C10G 45/38* (2013.01); *C10G 29/205* (2013.01); *C10G 45/06* (2013.01); *C10G 45/08* (2013.01);
(Continued)

(58) Field of Classification Search
CPC ..... C10G 45/38; C10G 45/08; C10G 45/36; C10G 45/06; C10G 45/00; C10G 45/04;
(Continued)

(56) References Cited

U.S. PATENT DOCUMENTS 7,645,376 B2 * 1/2010 Bouchy ..... B01J 23/85 208/108
7,670,477 B2 * 3/2010 Louret ..... B01D 3/141 208/208 R
(Continued)

FOREIGN PATENT DOCUMENTS

FR 2895417 A1 6/2007
WO 97/03149 A1 1/1997

OTHER PUBLICATIONS

International Search Report dated Feb. 3, 2014 issued in corresponding PCT/FR2013/052270 application (pp. 1-3).

*Primary Examiner* — Sharon Pregler
(74) *Attorney, Agent, or Firm* — Millen White Zelano and Branigan, PC; John Sapp; Csaba Henter

(57) ABSTRACT

This invention relates to a process for treatment of a gasoline that comprises diolefins, olefins and sulfur-containing compounds including mercaptans, consisting of a stage for treatment of the gasoline in a distillation column (2) comprising at least one reaction zone (3) including at least one catalyst that makes it possible to carry out the addition of mercaptans to the olefins that are contained in the gasoline that distills toward the top of the catalytic column.

11 Claims, 1 Drawing Sheet

(51) Int. Cl.

| | |
|---|---|
| ***C10G 45/32*** | (2006.01) |
| ***C10G 45/06*** | (2006.01) |
| ***C10G 45/08*** | (2006.01) |
| ***C10G 45/36*** | (2006.01) |

(52) U.S. Cl.
CPC ..... *C10G 45/32* (2013.01); *C10G 45/36* (2013.01); *C10G 2300/4087* (2013.01)

(58) Field of Classification Search
CPC ..... C10G 45/02; C10G 69/04; C07C 5/00; C07C 5/02; C07C 5/03; C07C 5/08
USPC .... 585/271, 273, 274, 261; 208/95, 97, 244, 208/271, 273, 274, 211, 216 R, 209, 210, 208/212, 213
See application file for complete search history.

(56) References Cited

U.S. PATENT DOCUMENTS

| | | | | |
|---|---|---|---|---|
| 8,236,172 | B2 * | 8/2012 | Podrebarac ..... | C10G 7/00 203/29 |
| 2005/0011811 | A1 | 1/2005 | Dean | |
| 2007/0170097 | A1 | 7/2007 | Louret et al. | |
| 2009/0223866 | A1 | 9/2009 | Bhan | |
| 2012/0043260 | A1 | 2/2012 | Podrebarac et al. | |

* cited by examiner

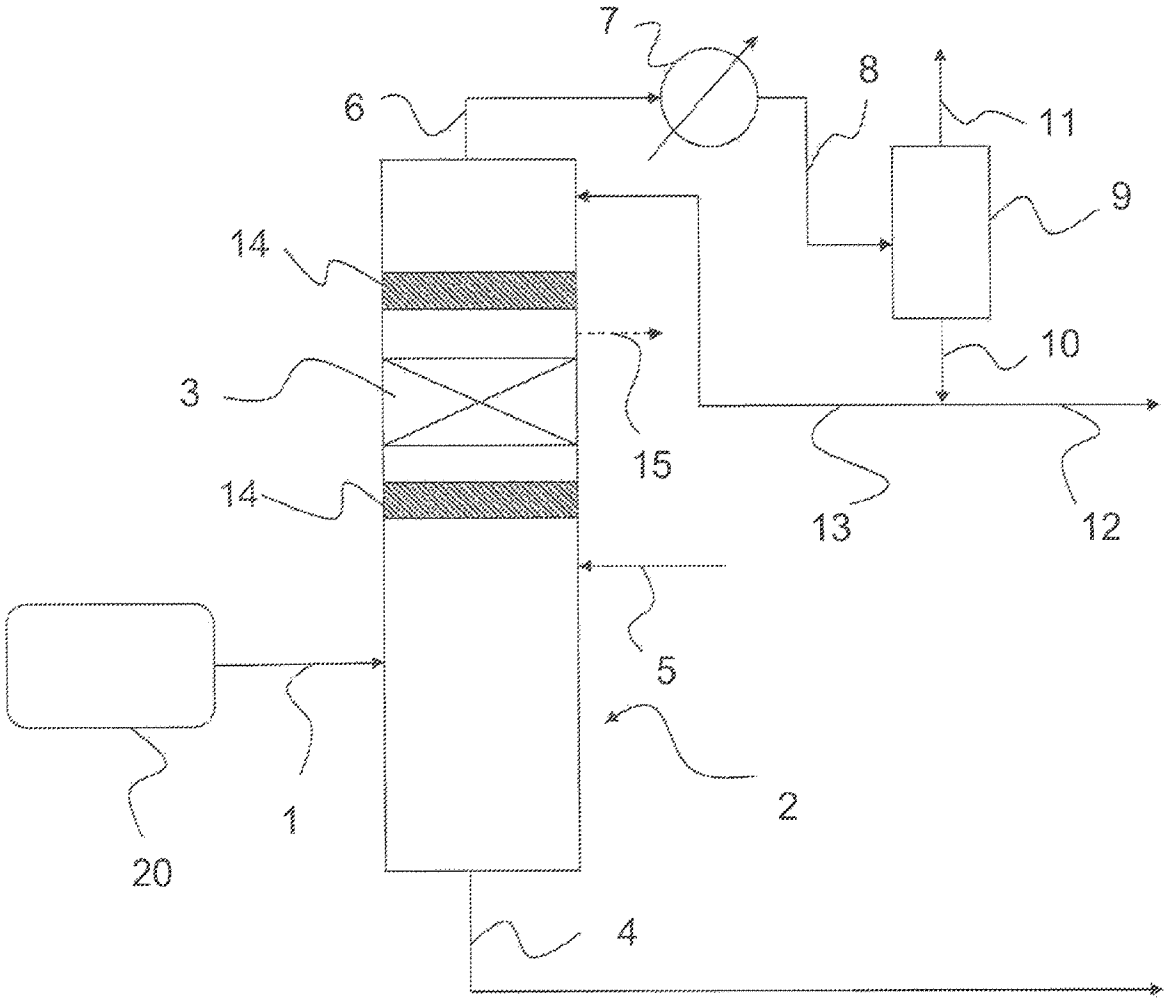
7
8
11
9
10
12
13
6
14
3
14
15
5
2
4
1
20

PROCESS FOR THE PRODUCTION OF A GASOLINE WITH A LOW SULFUR CONTENT

This invention relates to a process for treatment of a gasoline comprising diolefins, olefins, and sulfur-containing compounds including mercaptans for the purpose of providing a light fraction of this gasoline with a very low sulfur content while preserving the octane number and preferably converting the diolefins into olefins.

STATE OF THE ART

The production of reformulated gasolines meeting the new environmental standards requires in particular that their concentration of olefins be slightly reduced but their concentration of aromatic compounds (primarily benzene) and sulfur be significantly reduced. The catalytic cracking gasolines, which can represent 30 to 50% of the gasoline pool, have high olefin and sulfur contents. The sulfur that is present in the reformulated gasolines can be nearly 90%, attributed to the catalytic cracking gasoline (FCC, "Fluid Catalytic Cracking," or catalytic cracking in a fluidized bed). The desulfurization (hydrodesulfurization) of gasolines and primarily FCC gasolines therefore has an obvious importance for achieving the specifications.

The hydrotreatment (hydrodesulfurization) of the feedstock sent to the catalytic cracking leads to gasolines that typically contain 100 ppm of sulfur. The units for hydrotreatment of catalytic cracking feedstocks operate, however, under rigorous temperature and pressure conditions, which assumes a significant consumption of hydrogen and a high level of investment. In addition, the entire feedstock is to be desulfurized, which leads to the treatment of very large volumes of feedstock.

The hydrotreatment (or hydrodesulfurization) of the catalytic cracking gasolines, when it is carried out under conventional conditions known to one skilled in the art, makes it possible to reduce the sulfur content of the fraction. However, this process exhibits the major drawback of bringing about a very significant drop in the octane number of the fraction because of the saturation of olefins during hydrotreatment.

The document U.S. Pat. No. 4,131,537 teaches the advantage of fractionating the gasoline into several fractions, preferably three, based on their boiling points, and of desulfurizing them under conditions that can be different and in the presence of a catalyst that comprises at least one metal of group VIB and/or of group VIII. It is indicated in this patent that the larger benefit is obtained when the gasoline is fractionated into three fractions and when the fraction that has intermediate boiling points is treated under mild conditions.

The document FR 2 785 908 teaches the advantage of fractionating the gasoline into a light fraction and a heavy fraction and then of carrying out a specific hydrotreatment of the light gasoline on a nickel-based catalyst and a hydrotreatment of the heavy gasoline on a catalyst that comprises at least one metal of group VIII and/or at least one metal of group VIb.

The document U.S. Pat. No. 5,510,568 describes a process for eliminating the mercaptans of a hydrocarbon feedstock using a catalytic distillation column. The catalyst that is used is a catalyst with a substrate based on a metal of group VIII on which a thioetherification reaction is carried out by addition of mercaptans to diolefins. However, $H_2S$ and the mercaptans are known for being inhibitors of this type of catalyst, in particular when the metal of group VIII is palladium. This process is therefore not suitable for treating gasolines with a high sulfur content, which is generally the case of catalytic cracking gasolines.

The document U.S. Pat. No. 6,440,299 that discloses a process for elimination of the mercaptans of a hydrocarbon feedstock using a catalytic distillation column is also known. The catalytic bed of the column is located above the supply so as to treat only the light fraction of the feedstock. The catalyst that is used is a catalyst with a nickel-sulfide-based substrate on which a thioetherification reaction is performed by addition of mercaptans to the diolefins. As illustrated in the example of this patent, the process makes it difficult to obtain very low sulfur contents in the light fraction of the treated gasoline. Actually, when the quantity of diolefins in the feedstock is low and/or the quantity of mercaptans is large, the kinetics of the conversion of the mercaptans in the catalyst is made difficult. To keep conversion at a high level, it is necessary either to increase the temperature or to limit the internal traffic in the column. Operating at a higher temperature at a fraction iso-point of light gasoline can be done only by increasing the pressure of the column. This increase is, however, limited by the design of the column. The other solution that consists in limiting the internal traffic (by lowering, for example, the internal reflux rate) exhibits the drawback of degrading the separating power of the column, which promotes the recovery of light mercaptans that are not converted in the light fraction.

One object of the invention is therefore to propose a process for the production of a light gasoline with a very low sulfur content, i.e., having a sulfur content that is less than 50 ppm by weight and preferably less than 30 ppm or 10 ppm by weight, while limiting the octane number loss, which is also relatively simple and which requires an investment that is the smallest possible.

SUMMARY OF THE INVENTION

For this purpose, a process for the treatment of a gasoline that comprises diolefins, olefins, and sulfur-containing compounds including mercaptans is proposed, said process consisting of a stage for treating gasoline in the presence of hydrogen in a distillation column (2) comprising at least one reaction zone (3) including at least one catalyst, with the catalyst being in sulfide form and comprising a substrate, at least one element that is selected from group VIII, and at least one element that is selected from group VIb of the periodic table, with the element content of group VIII being between 1 and 30% by weight of oxide relative to the total weight of the catalyst, and with the element content of group VIB being between 1 and 30% by weight of oxide relative to the total weight of the catalyst, in which:

- Gasoline is injected into the distillation column at a level located below the reaction zone (3) in such a way as to separate a desulfurized light gasoline at a point located above the reaction zone and a heavy gasoline comprising the majority of the sulfur-containing compounds at the bottom of the column, and;
- The gasoline that distills at the top of the catalytic column is brought into contact with the catalyst of the reaction zone (3) and the hydrogen in such a way as to provide desulfurized light gasoline.

The process according to the invention thus implements a stage in which the sulfur-containing compounds of the mercaptan type (R-SH) that are present in the light gasoline fraction are transformed into heavier sulfur-containing compounds by reaction with the olefins of said fraction in the presence of a catalyst that has the characteristics mentioned above. This demercaptization reaction according to the invention is performed:

Primarily by direct addition to the double bond for producing sulfides whose temperature is higher than the fraction point;

Or, but in a minority fashion, by hydrogenolyzing means: the hydrogen that is present in the reactor produces, by contact with a mercaptan, $H_2S$ that will then be added to the double bond of an olefin for forming a heavier mercaptan than is found in the heavy gasoline at the bottom of the distillation column.

The level of conversion of mercaptans is very high (>90% and very often >95%) because the demercaptization reactions are performed selectively on the olefins that are present with very high contents in the feedstock.

The effectiveness of the conversion of mercaptans is connected to the presence of a mercaptan/olefin ratio in the light fraction that is very favorable for the demercaptization reaction. Actually, the mercaptans that distill at the top of the catalytic column are accompanied by the most volatile olefins of the feedstock. These most volatile olefins are generally short olefins, i.e., with a number of carbons that is generally between 4 and 6, and even 7, which are very reactive olefins for the demercaptization reactions. The process according to the invention therefore makes it possible to concentrate the reagents of the demercaptization reaction at the level of the catalytic bed and thus to promote the kinetics advantageously.

It should be emphasized that in the case of the presence of $H_2S$ in the feedstock, the latter is converted into mercaptan by addition to the olefins thanks to the catalyst and to the selected conditions. The thus produced mercaptans can also be converted into sulfides by reacting again with olefins. This transformation of optionally present $H_2S$ is advantageous to the extent that it makes it possible to avoid the entrainment of $H_2S$ at the top with the light gasoline fraction.

The conversion of $H_2S$ into heavy mercaptans or into sulfides and that are evacuated with the heavy fraction ensures a very low content of sulfur in the light fraction. Thus, $H_2S$ that is present up to a content on the order of 10 ppm by weight in the feedstock can be converted almost 100%.

The demercaptization reactions are performed on a sulfide catalyst that comprises at least one element of group VIII (groups 8, 9 and 10 of the new periodic table, Handbook of Chemistry and Physics, 76$^{th}$ Edition, 1995-1996), at least one element of group VIb (group 6 of the new periodic table, Handbook of Chemistry and Physics, 76$^{th}$ Edition, 1995-1996) and a substrate. The element of group VIII is preferably selected from among nickel and cobalt, and in particular nickel. The element of group VIb is preferably selected from among molybdenum and tungsten, and in a very preferred manner molybdenum. In a very preferred way, the catalyst comprises nickel and molybdenum.

Before being brought into contact with the feedstock that is to be treated, the catalyst undergoes a sulfurization stage. The catalyst carries out the demercaptization reactions that are desired only in its sulfide form. The sulfurization is preferably carried out in a sulforeducing medium, i.e., in the presence of $H_2S$ and hydrogen, so as to transform the metal oxides into sulfides such as, for example, $MoS_2$ and $Ni_3S_2$.

The catalyst that is used in the distillation column also carries out a selective hydrogenation of highly unsaturated compounds (diolefins and acetylenic compounds primarily).

The selective hydrogenation of light diolefins that are entrained with the gasoline that is distilling at the top of the column is performed by contact with the hydrogen on the catalyst according to the invention.

This reaction is especially important when the light fraction of the gasoline is used as a feedstock of an etherification unit (TAME type, for example) or is sent directly to the gasoline pool because these highly unsaturated compounds are precursors of gums.

One advantage of the process according to the invention is to limit the consumption of hydrogen that is used because the purpose of the process is only to hydrogenate the light diolefins that distill at the top of the column.

Another advantage of the process according to the invention sticks to the fact that $H_2S$ is not an inhibitor of the catalyst used in this invention, which is an advantage when the feedstock that is to be treated contains even low $H_2S$ contents.

In addition, the catalyst that is used in the process according to the invention is particularly selective relative to the hydrogenation of olefins: the diolefins that are present in the catalytic bed are preferably hydrogenated relative to the olefins. Thus, there is no phenomenon of competition between the reaction for hydrogenating the diolefins and the reaction for adding mercaptans to the olefins.

Another advantage of the process according to the invention resides in the fact that it is not necessary to desulfurize the light gasoline that is drawn off at the top of the distillation column because the majority of the sulfur-containing compounds have been transformed into compounds of higher molecular weight in such a way that they are entrained in the heavy gasoline fraction.

The molar ratio between the element of group VIII and the element of group VIB of the catalyst that is used in the process is preferably between 0.6 and 3 mol/mol.

The element of group VIII is preferably nickel or cobalt, and the element of group VIb is molybdenum or tungsten. In a very preferred manner, the element of group VIII is nickel, and the element of group VIb is molybdenum.

The content by weight of oxide of the element of group VIb is generally between 1 and 30% by weight relative to the total weight of the catalyst, and the content by weight of oxide of the element of group VIII is between 1 and 30% by weight relative to the total weight of the catalyst.

In a very preferred embodiment, the catalyst has a nickel oxide content of the catalyst of between 4% and 12% by weight, and a molybdenum oxide content is between 6% and 18% by weight relative to the total catalyst weight.

The substrate of the catalyst is selected from among alumina, nickel aluminate, silica, silicon carbide, by itself or in a mixture.

According to an alternative embodiment, the process comprises a stage for isomerization of olefins, contained in the light gasoline that distills at the top of the distillation column, whose double bond is in external position, into an isomer whose double bond is in internal position. This reaction is performed by bringing said light gasoline into contact with a catalyst, placed above or below the catalytic zone, which comprises at least one element of group VIII deposited on a porous substrate. For example, the porous substrate of the isomerization catalyst is selected from among alumina, nickel aluminate, silica, silicon carbide, by itself or in a mixture, and the metal of group VIII is selected from among nickel and palladium.

DETAILED DESCRIPTION OF THE INVENTION

This invention has as its object a process for the production of a light fraction of a gasoline that has a limited sulfur content starting from a gasoline, preferably obtained from a unit for catalytic cracking, coking, visbreaking, or steam-cracking.

This process makes it possible ultimately to obtain a light fraction whose content of sulfur and diolefins was lowered without significant reduction of the olefin content or the octane number, even for high conversion rates, and this without it being necessary to treat this light gasoline by means of a hydrodesulfurization section or to have recourse to processes that make it possible to restore the octane number of the gasoline.

The process according to the invention thus makes it possible to provide a light gasoline fraction whose total sulfur content is less than 50 ppm by weight, preferably less than 30 ppm, and even less than 10 ppm by weight.

Within the framework of this application, the expression "catalytic column" refers to a piece of equipment in which the catalytic reaction and the separation of the products take place at least simultaneously. The piece of equipment that is used can comprise a distillation column that is equipped with a catalytic section, in which the catalytic reaction and the distillation take place simultaneously with the specifically selected fraction point. It can also involve a distillation column combined with at least one reactor arranged inside said column and on a wall of the latter. The internal reactor can be operated as a vapor-phase reactor or as a liquid-phase reactor with a co-current or counter-current liquid/vapor circulation.

The use of a catalytic distillation column has as an advantage—relative to the implementation of a system comprising a reactor and a distillation column—the reduction of the number of individual elements, hence a lower investment cost. The use of a catalytic column makes possible a control of the reaction while promoting an exchange of the heat that is released; the reaction heat can be absorbed by the heat for evaporation of the mixture.

The Gasoline to be Treated

The process according to the invention makes it possible to treat any type of gasoline fraction that contains sulfur such as, for example, gasolines that are obtained from a unit for catalytic cracking, coking, visbreaking or steam-cracking or "direct distillation" gasolines that have been co-treated with an olefinic gasoline, preferably a gasoline fraction obtained from a catalytic cracking unit. The gasolines that can be treated by the process have a range of boiling points that typically extends from approximately the boiling points of hydrocarbons with 2 or 3 carbon atoms (C2 or C3) up to approximately 250° C., preferably from approximately the boiling points of hydrocarbons with 2 or 3 carbon atoms (C2 or C3) up to approximately 220° C., and in a more preferred manner from approximately the boiling points of hydrocarbons with 5 carbon atoms up to approximately 220° C. The process according to the invention can also treat feedstocks having end points that are lower than those mentioned above, such as, for example, a C5 fraction—180° C.

The sulfur content of the gasoline fractions, for example produced by catalytic cracking (FCC), depends on the sulfur content of the feedstock that is treated by the FCC, on the presence or absence of a pretreatment of the feedstock of the FCC, as well as on the end point of the fraction. In general, the sulfur contents of the entire gasoline fraction, in particular those coming from FCC, are greater than 100 ppm by weight, and most of the time they are greater than 500 ppm by weight. For gasolines having end points of greater than 200° C., the sulfur contents are often higher than 1,000 ppm by weight; they can even, in some cases, reach values on the order of 4,000 to 5,000 ppm by weight.

Furthermore, the gasolines that are obtained from catalytic cracking units (FCC) contain, on average, between 0.5% and 5% by weight of diolefins, between 20% and 50% by weight of olefins, and between 10 ppm and 0.5% by weight of sulfur, including in general less than 300 ppm of mercaptans. The mercaptans in general are concentrated in light fractions of gasoline and more specifically in the fraction whose boiling point is lower than 120° C.

It should be noted that the sulfur-containing compounds that are present in the gasoline can also comprise heterocyclic sulfur-containing compounds, such as, for example, thiophenes, alkylthiophenes, or benzothiophenes.

Description of the Process

The process according to the invention involves a distillation column that incorporates a catalytic reaction section. In said column, a distillation of the gasoline is carried out in at least two fractions, namely a so-called desulfurized "light" fraction whose range of the boiling points typically extends from approximately the initial point of the feedstock of the catalytic column up to an end point that is generally between 60° C. and 100° C., and a so-called "heavy" fraction whose range of boiling points extends from approximately the end point of the light gasoline fraction up to approximately the end point of the feedstock that is to be treated. The so-called "heavy" fraction contains almost all of the heavy sulfur-containing compounds that are initially present in the feedstock that is to be treated and the sulfur-containing compounds (primarily sulfides) obtained from the demercaptization reaction.

The operation of the catalytic column involves the simultaneous presence of two phases in the reaction zone, namely a liquid phase and a vapor phase that comprises hydrogen and light hydrocarbons, i.e., the hydrocarbons whose boiling point is lower than the selected fraction point.

As in any distillation, a temperature gradient exists in the system in such a way that the lower end of the column comprises compounds whose boiling point is higher than the one of the upper end of the column. The distillation makes it possible to separate the compounds that are present in the feedstock by a difference in the boiling point.

The reaction heat that is optionally generated in the catalytic column is evacuated by evaporation of the mixture on the distillation plate in question. Consequently, the thermal profile of the column is very stable, and the catalytic reactions that are carried out on the bed that is present at the top of the column do not disrupt its operation. Likewise, this stability of the thermal profile makes it possible to have stable reaction kinetics since they are isothermal in each separation stage.

Typically, the mercaptans that can react on the olefins that are in the presence of the catalyst are the following (non-exhaustive list): methyl mercaptan, ethyl mercaptan, n-propyl mercaptan, and isopropyl mercaptan.

The demercaptization reaction is performed on a catalyst that comprises at least one element of group VIII (groups 8, 9 and 10 of the new periodic table, Handbook of Chemistry and Physics, 76$^{th}$ Edition, 1995-1996), at least one element of group VIb (group 6 of the new periodic table, Handbook of Chemistry and Physics, 76$^{th}$ Edition, 1995-1996), and a substrate. The element of group VIII is preferably selected from among nickel and cobalt and in a very preferred manner is nickel. The element of group VIb is preferably selected from among molybdenum and tungsten and in a very preferred manner is molybdenum.

The content by weight of oxide of the element of group VIb is between 1 and 30% by weight relative to the total weight of the catalyst, and the content by weight of oxide of the element of group VIII is between 1 and 30% by weight relative to the total weight of the catalyst.

The substrate of the catalyst is preferably selected from among alumina, nickel aluminate, silica, silicon carbide, by itself or in a mixture. In a preferred manner, alumina is used, and in an even more preferred manner, pure alumina is used. In a preferred manner, a substrate that has a total pore volume that is measured by mercury porosimetry of between 0.4 and 1.4 $cm^3/g$ and preferably between 0.5 and 1.3 $cm^3/g$ is used. The specific surface area of the substrate is preferably between 70 $m^2/g$ and 350 $m^2/g$.

According to a preferred variant, the substrate is a cubic gamma-alumina or a delta-alumina.

The catalyst that is used in general thus comprises:

- A substrate that consists of gamma-alumina or delta-alumina with a specific surface area of between 70 $m^2/g$ and 350 $m^2/g$;
- A content by weight of oxide of the element of group VIb of between 1 and 30% by weight relative to the total weight of the catalyst;
- A content by weight of oxide of the element of group VIII of between 1 and 30% by weight relative to the total weight of the catalyst;
- A sulfurization rate of the metals that constitute said catalyst that is at least equal to 60%;
- A molar ratio between the metal of group VIII and the metal of group VIb is between 0.6 and 3 mol/mol.

In particular, it was found that the performance levels of the catalysts are improved when the catalyst has the following characteristics:

- A substrate that consists of gamma-alumina with a specific surface area of between 180 $m^2/g$ and 270 $m^2/g$;
- The content by weight of oxide of the element of group VIb is between 4 and 20% by weight relative to the total weight of catalyst, preferably between 6 and 18% by weight;
- The content by weight of oxide of the element of group VIII is between 3 and 15% by weight and preferably between 4% by weight and 12% by weight relative to the total catalyst weight;
- A sulfurization rate of the metals that constitute said catalyst that is at least equal to 60%;
- The molar ratio between the non-noble metal of group VIII and the metal of group VIb is between 0.6 and 3 mol/mol and in a preferred manner between 1 and 2.5 mol/mol.

A preferred embodiment of the invention corresponds to the use of a catalyst that contains a content by weight of nickel oxide (in NiO form) of between 4 and 12%, a content by weight of molybdenum oxide (in $MoO_3$ form) of between 6% and 18%, and a nickel/molybdenum molar ratio of between 1 and 2.5, with the metals being deposited on a substrate that consists only of alumina and with the sulfurization rate of the metals that constitute the catalyst being greater than 80%.

The catalyst according to the invention can be prepared by means of any technique that is known to one skilled in the art and particularly by impregnation of elements of groups VIII and VIb in the selected substrate.

After the introduction of the elements of groups VIII and VIb, and optionally a shaping of the catalyst, the latter undergoes an activation treatment. This treatment in general has as its object to transform the molecular precursors of the elements in the oxide phase. In this case, an oxidizing treatment is involved, but a simple drying of the catalyst can also be carried out. In the case of an oxidizing treatment, also called calcination, the latter is in general implemented in air or in dilute oxygen, and the treatment temperature is in general between 200° C. and 550° C., preferably between 300° C. and 500° C.

After calcination, the metals deposited on the substrate are found in oxide form. In the case of nickel and molybdenum, the metals are primarily in the form of $MoO_3$ and NiO. After contact with the feedstock that is to be treated, the catalysts undergo a sulfurization stage. The sulfurization is preferably carried out in a sulforeducing medium, i.e., in the presence of $H_2S$ and hydrogen, so as to transform the metal oxides into sulfides, such as, for example, $MoS_2$ and $Ni_3S_2$. The sulfurization is carried out by injecting into the catalyst a stream that contains $H_2S$ and hydrogen, or else a sulfur-containing compound that can break down into $H_2S$ in the presence of catalyst and hydrogen. The polysulfides such as dimethyl disulfide (DMDS) are $H_2S$ precursors that are commonly used for sulfurizing catalysts. The temperature is adjusted so that $H_2S$ reacts with the metal oxides to form metal sulfides. This sulfurization can be carried out in situ or ex situ (inside or outside of the reactor) of the demercaptization reactor at temperatures of between 200 and 600° C. and more preferably between 300 and 500° C.

According to the invention, the catalyst that is used in the reaction section can be found originally in the form of small-diameter extrudates or spheres. In the column, the catalyst is to have a structural shape that is suitable for the catalytic distillation so as to act both as a catalytic agent for carrying out the reactions but also as an agent for transfer of material so as to have separation stages available along the bed.

The gasoline that distills at the top of the column is brought into contact with the catalyst and hydrogen in the catalytic zone of the column at a temperature of between 50° C. and 250° C., and preferably between 80° C. and 220° C., and in an even more preferred manner between 90° C. and 200° C.

The hydrogen that is necessary for implementing the process can be injected directly into the catalytic column at a point that is located below the reaction zone. In an alternative way, hydrogen is mixed with the gasoline that is to be treated before its injection into the distillation column.

In the reaction section, the hydrogen/diolefin molar ratio is in general between 1 and 10 mol/mol. It is preferable, however, to operate only in the presence of a small excess of hydrogen relative to the diolefins so as to prevent hydrogenation of the olefins and to ensure a good octane number.

According to a preferred embodiment, a recycling of the excess hydrogen that is entrained with the desulfurized light gasoline is performed. For example, the light gasoline is cooled in a first step and then sent into a separator tank from where a desulfurized gasoline that is low in hydrogen is separated at the bottom of the tank and hydrogen is separated at the top of the tank. The thus recovered hydrogen is either injected directly into the catalytic distillation column or is injected with make-up hydrogen or optionally is mixed with the feedstock that is to be treated before the latter is sent into the catalytic distillation column.

The operating pressure of the catalytic distillation column is generally between 0.4 and 5 MPa, preferably between 0.6 and 2 MPa, and in an even more preferred manner between 0.6 and 1 MPa. The temperature that prevails in the reaction zone is in general between 50 and 150° C., preferably between 80 and 130° C.

Within the framework of the invention, it is also possible to use more than one catalytic bed in the reaction zone, for example two separate catalytic beds.

According to another preferred embodiment, an additional catalytic bed that comprises a catalyst for isomerization of olefins that comprises at least one metal of group VIII deposited on a porous substrate is placed either above or between the reaction zone and the point of injection of the gasoline that is to be treated. The porous substrate of this catalyst can be selected from among alumina, nickel aluminate, silica, silicon carbide, or a mixture of these oxides. In a preferred manner, alumina is used, and in an even more preferred manner, pure alumina is used. The metal of group VIII can be selected from among nickel and palladium. If the metal is palladium, it is preferably present by itself and with a content by weight of palladium relative to the total weight of catalyst (% by weight of metal) of between 0.1 and 2%.

The purpose of such a catalyst is to promote the isomerization reactions of olefins whose double bond is in external position into an isomer whose double bond is in internal position. Such an additional treatment makes it possible to improve the octane number of the light fraction.

According to a particular embodiment, the distillation column is configured for operating as a depentanizer, i.e., the column is used in such a way as to separate a light gasoline that comprises hydrocarbons having at most five carbon atoms at the top of the column.

According to another particular embodiment, the distillation column is configured for operating as a dehexanizer, i.e., the column is used in such a way as to separate a light gasoline that comprises hydrocarbons having at most six carbon atoms at the top of the column.

Other characteristics and advantages of the invention will be better understood and will become clearer from reading the description given below with reference to FIG. 1 that shows a schematic diagram of the process according to the invention.

With reference to FIG. 1, the feedstock that is to be treated by the process according to the invention can be obtained from, for example, a unit 20 for catalytic cracking, coking, visbreaking or steam-cracking. As shown in FIG. 1, the feedstock that is extracted from the unit 20 is treated directly by the process according to the invention.

The gasoline feedstock is sent via the pipe 1 into a catalytic distillation column 2. The catalytic distillation column comprises a catalytic zone 3 that comprises a catalyst bed as described above, making it possible to catalyze the reaction for adding mercaptans to olefins present in the feedstock that is to be treated. The catalytic zone 3 is positioned above the injection point of the gasoline that is to be treated. During operation, the distillation column 3 makes it possible to perform a separation of said feedstock into at least two gasoline fractions. A first fraction called a "light fraction" distills toward the top of the column, and a second fraction called a "heavy fraction" is drawn off at the bottom of the column via the pipe 4.

The light gasoline that distills at the top of the column encounters the catalytic bed of the reaction zone 3 and is brought into contact with the demercaptization catalyst. The demercaptization reaction is carried out in the presence of hydrogen that is provided by the pipe 5 that empties into the catalytic column 2 at a level that is preferably located below the catalytic zone 3. In an alternative way, the pipe 5 empties into the catalytic zone 3. It is also possible to inject hydrogen in a mixture with the feedstock that is to be treated, for example at the level of the pipe 1.

The catalytic column 2 is configured and regulated in such a way as to recover at least one desulfurized light gasoline fraction at the top of said column 2, i.e., above the catalytic zone 3. Actually, the light sulfur-containing compounds, for example of the C1-C3 mercaptan type, are transformed into sulfides by reaction with the olefins that are present in the initial feedstock. The thus produced sulfide compounds, having a greater molecular weight than the corresponding initial mercaptan, are entrained in the heavy gasoline fraction toward the bottom of the column 2.

The desulfurized light gasoline is drawn off at the top of the column via the pipe 6 and cooled by means of a heat exchanger train 7. The cooled light gasoline is then transferred using the pipe 8 into a gas/liquid separator 9. A gas effluent that contains the incondensable compounds, primarily hydrogen, is drawn off at the top of the separator via the pipe 11 while the liquid fraction of desulfurized light gasoline is drawn off at the bottom via the line 10. A portion of the desulfurized light gasoline is used, for example, to supply the gasoline pool (via the pipe 12), and another portion is returned into the distillation column 2 for ensuring a reflux of the distillation.

Furthermore, in a way simultaneous to the demercaptization reaction, a reaction for selective hydrogenation of diolefins into corresponding olefins—since the demercaptization catalyst also has a hydrogenation activity—takes place at the level of the catalytic zone 3.

According to an embodiment and as shown in FIG. 1, a lateral draw-off of the desulfurized light gasoline that distills at the top of the column via the line 15 (in dotted lines) is also performed. This so-called "intermediate" gasoline fraction is, as described above, then cooled before being treated in a gas/liquid separator.

In a preferred manner and as shown in FIG. 1, the distillation column also comprises at least one catalytic bed that comprises a catalyst for isomerization of the olefins. The catalyst makes it possible to isomerize selectively the olefins that have a double bond in internal position into their isomer with a double bond in external position.

Example 1

Two catalysts of different formulations were tested so as to identify the best candidate possible for implementing the process according to the invention. The characteristics of these two catalysts are presented in the table below:

| Catalyst | 1 | 2 |
|---|---|---|
| Active Phase | 18% by Weight of NiO | 5.8% by Weight of NiO/ 6.5% by Weight of MoO3 |
| Substrate | Delta-Alumina 2-4 mm Balls | γ-Alumina 2-4 mm Balls |
| Specific Surface Area $m^2/g$ | 135 | 150 |

40 $cm^3$ of each of these catalysts is charged into a fixed-bed-type pilot unit. Before the beginning of the test, the charged catalyst is sulfurized for 4 hours at 350° C. in a mixture that consists of n-heptane and 4% by weight of DMDS. The other operating conditions of the sulfurization are:

VVH=2 $h^{-1}$ $H_2$/Feedstock that is to be treated=400 NL/L

P=2.7 MPa

The characteristics of the treated gasoline feedstock and the operating conditions under which the catalysts were evaluated are combined in the following table:

| | |
|---|---|
| Starting Point (° C.) | 37 |
| End Point (° C.) | 215 |
| S Feedstock (ppm of S) | 520 |
| RSH Feedstock (ppm of S) | 63 |
| Olefins Feedstock (% by Weight) | 33.4 |
| Diolefins Feedstock (% by Weight) | 0.64 |
| T (° C.) | 160 |
| P (MPa) | 1.3 |
| H2/Feedstock that is to be Treated (NL/L) | 15 |
| VVH ($h^{-1}$) | 6 |

The compared performances of the two catalysts in terms of hydrogenation of the diolefins, in terms of conversion of the olefins, and in terms of conversion of mercaptans are provided in the following table:

| Catalyst | 1 | 2 |
|---|---|---|
| Conversion of Diolefins by Hydrogenation (%) | 53 | 82.2 |
| Conversion of Olefins by Hydrogenation (%) | 1.4 | <0.1 |
| C1-C3 RSH in the Effluent (ppm of S) | 12 | 2 |

Catalyst 2 thus has an activity of conversion of the light mercaptans and of hydrogenation of the diolefins that is greater than that of the catalyst 1. The catalyst 2 is in addition very selective, because the hydrogenation of the olefins on the catalyst 2 is low compared to that of the diolefins.

Example 2 (According to the Invention)

A catalytic distillation column with a diameter of 5 cm and a height of 12 m: The column is charged with a bed of 3 m of catalyst that is located above the injection point of the gasoline. The feedstock that is used is the same as that of the fixed-bed tests; the operating conditions are as follows:

Top pressure: 0.9 MPa

Mean temperature of the catalytic bed: 130° C.

$H_2$/Feedstock that is to be treated=2 NL/L

Yield of the top product: 25%

The fraction that is recovered at the top of the column after stabilization of the unit is analyzed. The results are provided in the following table:

| | |
|---|---|
| S (ppm of S) | 6 |
| RSH (ppm of S) | 4 |
| Olefins (% by Weight) | 58.6 |
| Diolefins (ppm by Weight) | 144 |

The fraction that is recovered at the top has a very low sulfur content, less than 10 ppm of sulfur. In addition, a large quantity of diolefins of this light fraction was converted on the catalytic bed without significant conversion of olefins.

The invention claimed is:

1. A process for treating a gasoline comprising diolefins, olefins, and sulfur-containing compounds including mercaptans, consisting of a stage for treating gasoline in the presence of hydrogen in a distillation column (2) comprising at least one reaction zone (3) including at least one catalyst, with the catalyst being in sulfide form and comprising a substrate that consists of gamma-alumina or delta-alumina with a specific surface area of between 70 $m^2/g$ and 350 $m^2/g$, a content by weight of oxide of the element of group VIb of between 1 and 30% by weight relative to the total weight of the catalyst, a content by weight of oxide of the element of group VIII of between 1 and 30% by weight relative to the total weight of the catalyst, a sulfurization rate of the metals that constitute said catalyst that is at least equal to 60%, a molar ratio between the metal of group VIII and the metal of group VIb of between 0.6 and 3 mol/mol, in which:

gasoline is injected into the distillation column at a level located below the reaction zone (3) in such a way as to separate a desulfurized light gasoline at a point located above the reaction zone and a heavy gasoline comprising the majority of the sulfur-containing compounds at the bottom of the column, and concurrently the gasoline that distills at the top of the catalytic column is brought into contact with the catalyst of the reaction zone (3) and the hydrogen in such a way as to provide desulfurized light gasoline, and in which the distillation column is configured for operating as a depentanizer in such a way as to provide a light gasoline that has at most 5 carbon atoms or in which the distillation column is configured for operating as a dehexanizer in such a way as to provide a light gasoline that has at most 6 carbon atoms.

2. The process according to claim 1, in which the element of group VIII is nickel or cobalt.

3. The process according to claim 1, in which the element of group VIb is molybdenum or tungsten.

4. The process according to claim 1, in which the element of group VIII is nickel and the element of group VIb is molybdenum.

5. The process according to claim 4, in which the content of nickel oxide is between 4% and 12% by weight, and the content of molybdenum oxide is between 6% and 18% by weight relative to the total weight of catalyst.

6. The process according to claim 1, in which the column also comprises a catalytic bed arranged below or above the reaction zone (3) and comprises a catalyst for isomerization of the olefins, with said isomerization catalyst comprising at least one metal of group VIII deposited on a porous substrate.

7. The process according to claim 1, in which the metal of group VIII is palladium, and the palladium content expressed in % by weight of palladium metal relative to the weight of the isomerization catalyst is between 0.1 and 2%.

8. The process according to claim 7, in which the porous substrate of the isomerization catalyst is alumina, nickel aluminate, silica, silicon carbide, or a mixture thereof, and the metal of group VIII is nickel or palladium.

9. The process according to claim 1, in which the distillation column is configured for operating as a depentanizer in such a way as to provide a light gasoline that has at most 5 carbon atoms.

10. The process according to claim 1, in which the distillation column is configured for operating as a dehexanizer in such a way as to provide a light gasoline that has at most 6 carbon atoms.

11. The process according to claim 1, in which the gasoline that is to be treated is directly obtained from a unit for catalytic cracking, coking, visbreaking or steam-cracking.

* * * * *